US006641252B2

(12) United States Patent
Hori

(10) Patent No.: US 6,641,252 B2
(45) Date of Patent: Nov. 4, 2003

(54) PRINTING SYSTEM OF INK JET PRINTER AND INK SELECTING METHOD

(75) Inventor: Takeshi Hori, Tokyo (JP)

(73) Assignee: Fuji Xerox Co., Ltd. (JP)

( * ) Notice: Subject to any disclaimer, the term of this patent is extended or adjusted under 35 U.S.C. 154(b) by 0 days.

(21) Appl. No.: 10/133,183

(22) Filed: Apr. 26, 2002

(65) Prior Publication Data

US 2003/0001923 A1 Jan. 2, 2003

(30) Foreign Application Priority Data

May 11, 2001 (JP) ..... 2001-141316

(51) Int. Cl.[7] ..... B41J 2/145; B41J 2/15; B41J 2/21; B41J 2/205

(52) U.S. Cl. ..... 347/41; 347/43; 347/15

(58) Field of Search ..... 347/41, 43, 15, 347/19

(56) References Cited

FOREIGN PATENT DOCUMENTS

| | | | |
|---|---|---|---|
| JP | A 05-320551 | 12/1993 | |
| JP | A 07-242847 | 9/1995 | |
| JP | A 08-041400 | 2/1996 | |
| JP | A 08-259868 | 10/1996 | |
| JP | A 11-181340 | 7/1999 | |
| JP | A 2000-169775 | 6/2000 | |
| JP | 2002249693 | * 9/2002 | ..... B41J/2/01 |

* cited by examiner

*Primary Examiner*—Thinh Nguyen
(74) *Attorney, Agent, or Firm*—Hayes Soloway P.C.

(57) ABSTRACT

The object of the present invention is to provide a printing system of an ink jet printer that can obtain a sufficient image density by suppressing a feathering.

When one dot line is drawn and that line width is assumed to be "x" and a resolution in a main scanning direction is assumed to be "a" and a resolution in a sub scanning direction is assumed to be "b", the ink satisfying the condition that $x=(a^2+b^2)^{1/2}$ and a TEP value of the one dot line is 10 or less is used.

8 Claims, 1 Drawing Sheet

PRINTING SYSTEM OF INK JET PRINTER AND INK SELECTING METHOD

BACKGROUND OF THE INVENTION

1. Field of the Invention

The present invention relates to improvements in a printing system of an ink jet printer and an ink selecting method, and more particularly to an improvement to attain an excellently printing quality.

2. Description of the Related Art

Recently, in association with the popularization of a personal computer, a printer as a data output apparatus, especially, a printer based on an ink jet type has been extremely technically advanced. The products having various uses and features, such as an product that is proud of photographic quality, an product that carries out a printing operation at a high speed similar to that of a laser printer, and the like, are on the market.

The printer based on the ink jet type usually includes color inks having a plurality of colors and black ink of a single color. Thus, color image can be printed in addition to a printing operation of a single color character.

In recent years, the desire of the usage of the ink jet type printer not only for a personal use but also for an office work has been increased as the change in needs of a user. Thus, the necessity of printing on a large scale requires not only the printing of a high speed but also the sharpness of a character similar to that of the laser printer, and the printing adaptability on a plain paper.

The printer based on the ink jet type uses liquid ink as a recording agent, different from the laser printer. Thus, the printing quality is liable to be influenced by the absorption property of a printed material (a recording paper). That is, the so-called feathering in which the permeation of ink along a paper fiber causes the ink to be extended from an image boundary in a shape of beard occurs on a plain paper where permeation of ink is not particularly controlled. Hence, this result in a problem in a business application in which the character printing quality is considered to be important.

As a means to solve those various problems, a glossy paper for ink jet is already known in which improvement is made to the recording paper as a material to be printed. If this glossy paper is used, it is possible to carry out the printing operation having little feathering. However, the glossy paper is typically expensive over the plain paper. Thus, if it is used for the business work in which a large number of papers are used, it is disadvantageous in view of a running cost. For this reason, it is desired to attain the improvement for the sake of the printing operation of the plain paper from the side of the ink.

When the ink for the ink jet is roughly classified from the viewpoint of the permeability to a paper, it is roughly classified into two types, namely, a permeability type and a non-permeable type.

In order to avoid the above-mentioned feathering, typically, an addition rate of permeation agent to be added to the ink is reduced and the surface tension of the ink is increased so that the ink is hard to be permeated. However, if it is excessively non-permeant, a diameter of an ink drop (hereafter, referred to as [Dot Diameter]) is reduced after the ink drop is hit on the paper and dried. Then, at a time of solid patch of full duty (perfect paint-out), especially in a case of a lower resolution mode, a portion on which the ink is not deposited is generated between ink dots (hereafter, referred to as [Portion Between Dots]). Thus, this may result in a problem that a sufficient image density can not be obtained.

In order to obtain the excellent printing quality on the plain paper, it is especially necessary to reserve the sufficient image density in the solid image and the character printing quality at the same time. However, since they have the relation of mutual trade-off, it is difficult to attain both of them. Thus, actually, it is typically done to repeatedly carry out a series of cycles, such as (1) the trial production of ink (2) the printing operation (3) the evaluation of the image density and the character printing quality (4) the trial production of ink to test various types of inks and accordingly determine the composition of the ink.

This results in problems that a long time is always required to develop the ink and that a collection of a development cost causes an entire cost of an ink jet apparatus to be increased, and so on.

SUMMARY OF THE INVENTION

It is therefore an object of the present invention to provide a printing system of an ink jet printer, which can solve the above-mentioned problems of the conventional technique and suppress the feathering and obtain a sufficient image density, and also provide an ink selecting method of an ink jet printer, which can easily select ink suitable for the ink jet printer and a recording paper.

The present invention is a printing system of an ink jet printer which discharges an ink from the ink jet head and carries out a printing operation while relatively shifting an ink jet head and a recording paper in two shifting directions orthogonal to each other. In order to attain the above-mentioned object, it is especially designed such that when a resolution in any one shifting direction of the two shifting directions is assumed to be "a" and a resolution in the other shifting direction orthogonal to the one shifting direction is assumed to be "b" and when the ink jet head is driven to draw a straight line having no overlap of dots in the other shifting direction along the one shifting direction, a property of the ink is adjusted on the basis of the resolution "a", the resolution "b" and a property of the recording paper, in such a way that a line width "x" of this straight line is $x=(a^2+b^2)^{1/2}$ and a TEP value is 10 or less.

The property of the ink is adjusted correspondingly to the resolutions "a", "b" and the property of the recording paper so that the line width "x" when the straight line having no overlap of the dots is drawn is $x=(a^2+b^2)^{1/2}$. Thus, the sufficient image density can be obtained even in the solid patch (perfect paint-over) of the full duty. Also, the property of the ink is adjusted correspondingly to the property of the recording paper so that the TEP value of this straight line is 10 or less. Thus, the occurrence of the feathering is prevented. Hence, the usage of the ink satisfying those two conditions enables the feathering to be suppressed, and thereby enables the sufficient image density to be obtained.

Here, there is no special limitation on the colorant included in the ink. However, the most suitable colorant is pigment.

This is because the pigment ink is insoluble in solvent and it is dispersed, and the permeation is hard to be induced as compared with dye ink, and it is advantageous from the viewpoint of the feathering prevention.

Also, in a case of a business application in which a large number of recording papers are consumed, the property of the ink is desired to be adjusted so as to satisfy the conditions of $x=(a^2+b^2)^{1/2}$ and the TEP value of 10 or less when printing on a plain paper.

The property of the ink is adjusted so as to be optimal for the plain paper. Thus, printing on a large scale can be carried out at a low cost.

In particular, those conditions are effective if they are applied to the ink of a carbon black in which a printing operation is carried out at a single color.

This is because the occurrence of the feathering and the lack of the image density are outstanding in the case of the carbon black print in which the single color is printed only once, as compared with the case of the color print in which a printing operation is carried out while a plurality of colors overlap each other.

A piezoelectric element can be used as a driving source for discharging the ink from the ink jet head.

An ink jet printer is well known which is designed so as to be able to select a resolution. Here, a maximum resolution of the ink jet printer is determined by a hardware configuration such as characteristic of stepping motor for relatively shifting the ink jet head and recording paper. And selectable resolutions are determined based on a minimum shifting amount calculated by the maximum resolution. That is, if the maximum resolution is 1200 dpi (dot/inch), it is possible to select 1200 dpi (minimum shifting amount) 600 dpi (double of minimum shifting amount), 400 dpi (triple of minimum shifting amount) and 300 dpi (quadruple of minimum shifting amount), respectively. These resolutions are integer multiple of the minimum shifting amount by defining as the maximum resolution peculiar to an ink jet printer. In the case of the ink jet printer having such design, a driving timing and a driving time of the piezoelectric element are controlled correspondingly to the selected resolution at the time of the printing. Thus, if the property of the ink is adjusted so as to attain the above-mentioned two conditions for any one resolution defined as a reference, the two conditions can be attained also for the other resolutions.

Moreover, it is also possible to apply present invention to the configuration of a so-called bubble jet, in which the ink is heated to thereby drive the ink jet head and accordingly discharge the ink.

Also in this case, the heating timing and the heating time are controlled correspondingly to the selected resolution in the printing operation. Thus, if the property of the ink is adjusted so as to attain the above-mentioned two conditions for any one resolution defined as the reference, the two conditions can be attained also for the other resolutions.

In a case of an ink jet printer that does not carry out the special ink discharge control based on the resolution although the resolution can be selected in the printing operation, the property of the ink is adjusted so as to insure the two conditions in the situation that the roughest resolution is selected to carry out the printing operation, in order to reserve the sufficient image density even if the roughest resolution is selected to carry out the printing operation. For example, in the case that the resolution can be selected from 1200 dpi, 600 dpi, 400 dpi and 300 dpi, the property of the ink is desired to be adjusted so as to satisfy the two conditions even if the printing operation of 300 dpi is done.

However, "Roughest Resolution" in this explanation does not include the resolution corresponding to a draft mode (an extremely rough line image used only to check a printing state and the like). In the rough printing used only to check the printing state, the function of perfectly painting out the solid patch portion is not originally required, and there is no meaning in the complementation for the portion between the dots. Also, if the size of the ink dot is adjusted so as to attain the image density in the solid patch portion at the draft mode, a trouble is brought about in the precise printing and drawing at the high resolution.

An ink selecting method according to the present invention is an ink selecting method of an ink jet printer, which discharges an ink from the ink jet head, and then carries out a printing operation while relatively shifting an ink jet head and a recording paper in two shifting directions orthogonal to each other. In order to attain the above-mentioned object, it is designed such that a resolution in any one shifting direction of the two shifting directions is assumed to be "a", and a resolution in the other shifting direction orthogonal to the one shifting direction is assumed to be "b", and an operation for driving the ink jet head and then drawing a straight line having no overlap of dots in the other shifting direction along the one shifting direction is repeatedly executed while different kind of ink is applied each time. Then, a line width "x" of the straight line is measured for each execution, and the ink satisfying a condition that this line width "x" is $x=(a^2+b^2)^{1/2}$ and a TEP value of this straight line is 10 or less is selected as the ink suitable for the ink jet head and the recording paper.

As mentioned above, the straight line having no overlap of the dots is drawn. Then, the allowance or rejection of the ink is judged only on the basis of the TEP value and the line width "x" of the straight line. Thus, the process required to judge the allowance or rejection of the ink is largely simplified as compared with the conventional ink selecting method of actually printing the character and the solid image and then judging the allowance or rejection of the ink. Hence, the total time and labor cost are reduced which are required to develop and select the ink. Moreover, the reduction in a development cost leads to the reduction in a manufacturing cost of an apparatus.

Also, when such an ink selecting method is applied, it is desired that in the two shifting directions, the shifting direction superior in the straightly shifting accuracy and the resolution is defined as the one shifting direction, and the remaining other shifting direction is defined as the other shifting direction.

In the situation that the feeding operation is stopped in the shifting direction which is relatively inferior in the straightly shifting accuracy and the resolution (the positioning accuracy), the feeding operation is performed only on the shifting direction superior in the straightly shifting accuracy and the resolution, and the straight line is drawn. Thus, the evaluation of the TEP value with regard to the feathering is made further accurate. (The TEP value is evaluated on the basis of the deviation in a distance between an ideal boarder line and an actually drawn image boundary. Hence, the proper evaluation can be attained in that having the higher accuracy of the actually drawn straight line).

DETAILED DESCRIPTION OF THE PREFERRED EMBODIMENT

Figure 1:
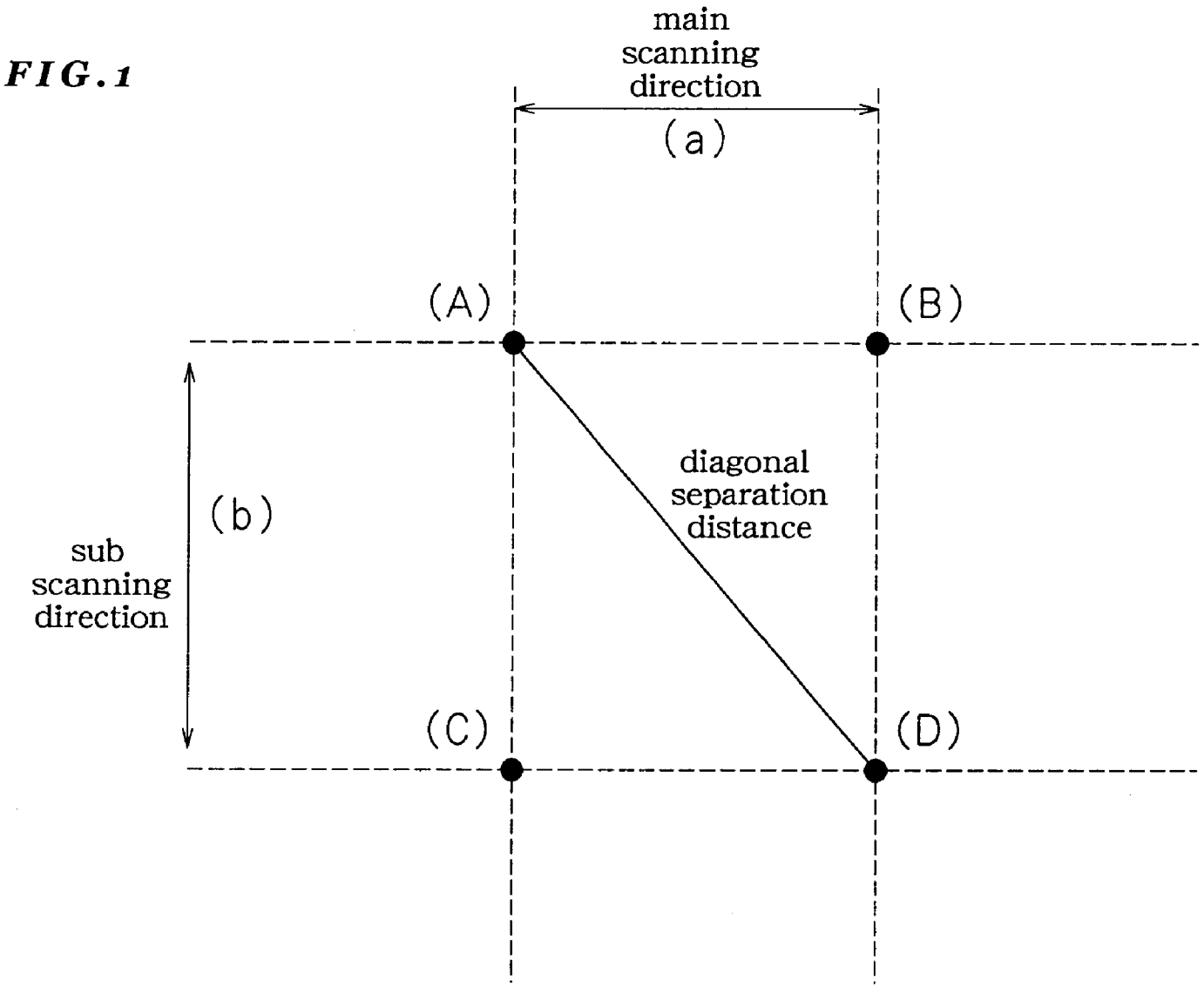
FIG. 1 is a conceptual view showing a relation between an array of dots formed by inks discharged onto a recording paper and a dot size required to completely paint over a portion between the dots.

At first, when considering the subject to reserve a character printing quality without any feathering and a sufficient image density, the applicant et al, remarks three points of a resolution of an ink jet printer to be used for a printing operation, a size of a dot diameter required to paint over a portion between ink dots, and a TEP value implying a quantitative evaluation value of the feathering, and then researches a condition required to carry out the properly printing operation.

That is, as the amount of the discharged ink drops is larger, the portion between the dots is much easily painted over. On the contrary, if the amount of the ink drops is too much and they reach to a rear side of a paper thereby stain the paper. Also, if a large amount of ink drops are tried to be discharged in order to paint over the portion between the dots, this requires a large current switching IC having a margin of a capacity, and thereby leads to the problems of an increase in a cost of the ink jet printer and an increase in an ink consumption amount.

So, an ink design is required in which the portion between the dots can be painted over at a minimum amount of ink drops. For this reason, as described in the paragraph referring to the related art, the ink permeability is improved to thereby provide a dot expansion property. However, if the ink permeability is too strong, the feathering (the blur of the ink) sometimes causes an ink boundary to be fuzzy and thereby causes the printing quality to be degraded. After all, the necessary ink is the ink in which at few ink drops, it is possible to paint over the portion between the dots and the feathering is small.

So, the present invention solves the problem to paint over the portion between the dots by setting a line width, when one dot line is drawn, to be equal to or longer than a distance between the dots, and copes with the problem of the feathering by setting a deviation of a distance (TEP value: Tangental Edge Profile) between an ideal outline when one dot line is similarly drawn and a image boundary when it is actually drawn, to be 10 or less. In short, by selecting the ink satisfying those two conditions at the same time, it is possible to obtain the ink in which the character having both the sufficient image density for solid image and the little feathering for the character printing can be attained.

The condition to produce the ink will be described below in detail.

At first, the dot diameter is described which is required to paint over the portion between the dots.

For example, as shown in FIG. 1, when remarking any one dot (A) discharged onto the paper by discharging the ink of the full duty (the complete paint over) and the peripheral three dots (B), (C) and (D) adjacent to the dot (A), we found out from an experiment that the white background in the paint-out portion is not outstanding, and that a separation distance (a) between the dots (A) and (B) adjacent to each other in a main scanning direction is insufficient as the size of the ink dot to obtain a maximum image density satisfying a line image density, and that even a separation distance (b) between the dots (A) and (C) in a sub scanning direction is also insufficient, and that a size is required which corresponds to a diagonal separation distance $(a^2+b^2)^{1/2}$ between the dots (A) and (B) located on a diagonal line.

By the way, the main scanning direction in this explanation is the shift direction, which is relatively superior in straightly shifting accuracy and resolution (positioning accuracy), in two axes orthogonal to each other to relatively shift an ink jet head and a recording paper. Also, the sub scanning direction is the other shift direction orthogonal to the main scanning direction.

The usual ink jet printer is designed such that the ink jet head is shifted right and left along a carriage guide, and a feeding operation in a direction orthogonal to the carriage guide is performed on the recording paper, and the ink jet head and the recording paper are relatively shifted. Thus, typically, the shifting direction of the ink jet head is higher in the straightly shifting accuracy and the resolution than the feeding direction of the recording paper. Hence, in the usual ink jet printer, it can be doubtlessly understood that the main scanning direction implies the shifting direction of the ink jet head, and the sub scanning direction implies the feeding direction of the recording paper.

Sometimes, a large ink jet printer for special usage is designed so as to fix the recording paper and shift the ink jet head longitudinally and laterally. However, even under such design, the feeding direction which is higher in the straightly shifting accuracy and the resolution is defined as the main scanning direction, and the feeding direction orthogonal to it is defined as the sub scanning direction.

From the above-mentioned reason, the dot diameter required to paint over the portion between the dots can be determined by the diagonal separation distance $(a^2+b^2)^{1/2}$ that is determined on the basis of the separation distance "a" between the adjacent dots in the main scanning direction and the separation distance "b" between the adjacent dots in the sub scanning direction. Here, the separation distance "a" between the adjacent dots in the main scanning direction substantially implies the resolution in the main scanning direction, namely, the value of the minimum feeding amount with regard to the shift of the ink jet head (typically, the shift amount corresponding to a shift instruction corresponding to one pulse to a driving pulse motor for shifting the ink jet head right and left along the carriage guide). Also, the separation distance "b" between the adjacent dots in the sub scanning direction substantially implies the resolution in the sub scanning direction, namely, the value of the minimum feeding amount with regard to the shift of the recording paper (typically, the shift amount corresponding to a shift instruction corresponding to one pulse to a pulse motor for driving a paper feeding roller and a tractor for feeding the recording paper in a direction orthogonal to the carriage guide).

Thus, or example, in an ink jet printer having a resolution of 720 dpi (main scanning)×360 dpi (sub scanning), a minimum feeding amount "a" in the main scanning direction is about 35 micro meter, and a minimum feeding amount "b" in the sub scanning direction "b" is about 70 micro meter. Thus, the above-mentioned value of the diagonal separation distance $(a^2+b^2)^{1/2}$ is about 79 micro meter. Hence, the dot diameter having the size of 79 micro meter or more is required in order to perfectly paint over the portion between the dots.

Moreover, in the present invention, in order to measure the size of the ink dot, the size of the ink dot itself discharged onto the paper is not measured. Instead, the line width when one dot line is drawn by the ink jet printer is measured to thereby evaluate the size of the ink dot. Accordingly, the allowance or rejection of the size of the ink dot is judged depending on whether or not the line width reaches the diagonal separation distance $(a^2+b^2)^{1/2}$.

The one dot line in this explanation implies the straight line drawn by shifting the ink jet head only once in the main scanning direction while the ink is continuously discharged from one nozzle of the ink jet head, in the situation that the recording paper is substantially fixed, namely, in the situation that the feeding operation is not performed on the recording paper. In short, it is the straight line in which the overlap of the dot is not applied to the feeding direction of the recording paper at all.

When the line is drawn by discharging the ink from a plurality of nozzles, even if the plurality of nozzles are aligned on the straight line along the shifting direction of the ink jet head, the influence of a variation in an ink discharging direction for each nozzle and the like causes a width of the line to be larger than the actual dot diameter. This brings about a problem that it is difficult to grasp the original dot diameter based on the width of the line. However, since the line width of the one dot line drawn by the ink discharged from the single nozzle is measured as mentioned above, this kind of the problem can be solved to exactly measure the size of the ink dot. With regard to this point, the case of a TEP measurement as described later is similar.

The reason why the dot diameter is not remarked and the line width is remarked is to avoid the problem that it is difficult to exactly measure the dot size (dot diameter) if on a paper having a fiber of a size which can not be ignored as compared with the dot diameter, especially, on a plain paper and the like, the ink drop discharged onto the paper permeates along the undulation of the fiber in a particular direction to thereby deform the shape of the dot. The line width of the one dot line is hard to be influenced by the deformation in the shape of the individual dot, and it is substantially constant. Thus, the operation for measuring the width is easy. Moreover, the reliability of the measured result is high.

In particular, this embodiment is designed so as to shift the ink jet head in the main scanning direction, which is superior in the straightly shifting accuracy and the resolution with regard to the feeding operation, and draw the one dot line. Thus, it is possible to obtain the straight line, which is smooth and high in linearity and composed of minutely continuous units of the ink dots. Hence, this is very advantageous in the measuring operation and the measurement accuracy.

As mentioned above, the ink producing condition under which the sufficient image density can be obtained is determined in accordance with the line width when the one dot line is drawn. The judgment with regard to the allowance or rejection of the image density based on the line width will be described later.

The TEP value will be described below. The TEP value is the quantitative unit of the character printing quality (for example, refer to [Base And Application of Electronic Photograph: Second Version] by Corona Corporation, p451) as known well, and it is a method of measuring a degree of a ruggedness of an image edge. The applicant et al, applies this method to the character evaluation of the ink jet recording, and further produces a simple ink jet printer only for one dot line printing, which can carry out a printing operation at a desirable resolution (a test ink jet printer for an ink evaluation), and then produces many trial inks, and fills the various trial inks in the simple ink jet printer, and draw the above-mentioned one dot line, and measures the TEP value of the one dot line drawn with each test ink, and further inserts several trial inks into the existing ink jet printer, and also executes the printing operation of the character, and thereby carries out the subjective evaluation for each test ink.

By the way, the measurement of the line width and the measurement of the TEP value use a dot analyzer DA-6000 available from Oji Measurement Unit.

The ink producing method will be described below.

The present invention can be applied to any of dye system ink and pigment system ink. However, if it is applied to the pigment system ink, it may be considered to be further effective. This is because the pigment ink, in which colorant is insoluble in solvent and dispersive system, is hard to be permeated as compared with the dye system ink. Thus, it has the tendency that the portion between the dots is hard to be painted over.

As the pigment colorant, it is possible to use inorganic pigment (carbon black), organic pigment (insoluble azo pigment, soluble azo pigment, Phthalocyanine system pigment, Iso-indolinone system pigment, Quinacridone system pigment, Perylene system pigment) and the like. In addition, it is also possible to use processed pigment (graft carbon and the like) in which the surface of the pigment is processed by using resin and the like).

As for the dye system ink, for example, it can include the ink having at least one kind of dye among a direct dye and an acid dye as the colorant. The direct dye can include CI. Direct Yellow, CI. Direct Blue, CI. Direct Red and the like. Also, the acid dye can include CI. Acid Yellow, CI. Acid Blue, CI. Acid Red and the like.

The contents of those colorants in the ink composition is desired to be used in a range between 1 and 10 wt % (a weight percent) as a solid component, by considering the stableness of ink, the print density on a recorded paper, and further the clogging, the discharging property and the like.

Also, as the solvent used in the ink for the ink jet printer according to the present invention, there is water-soluble organic solvent besides ion-exchanged water. As an example of the water-soluble organic solvent, there are: the alkyl alcohol ether kind having the carbon number of 1 to 4, such as Methyl alcohol, Ethyl alcohol, n-Propyl alcohol, iso-Propyl alcohol, n-Butyl alcohol, sec-Butyl alcohol, Tert-butyl alcohol, iso-Butyl alcohol and the like; the amide kind, such as Dimethyl-formamide, Dimethyl-acetamide and the like; the Ketone or Ketone alcohol kind, such as Acetone, Diacetone alcohol and the like; the ether kind, such as tetra-Hydrofuran, Dioxane and the like; the Polyalkylene glycol kind, such as Polyethylene glycol, Polypropylene glycol and the like; the Alkylene glycol kind including a carbon atom having two to six Alkylene bases, such as Ethylene glycol, Propylene glycol, 1,2,6-Hexane triol, thio-Diglycol, Hexylene glycol and the like; and the low-rank Alkylether kind of Polyalcohol, such as Glycerin, Ethylene glycol methylether, Diethylene glycol monomethyl (or ethyl) ether, Triethylene glycol monomethyl (or ethyl) ether and the like.

In addition, popularized dispersible agent, detergent, viscosity modifier, surface tension modifier, pH modifier, anti-oxidant, fungi-proof agent, chelating 20 agent and the like can be added to the ink for the ink jet printer according to the present invention, as necessary.

Also, in this embodiment, an L-paper available from Xerox Corporation is used as a paper for ink absorption, and the printing property of the ink to the plain paper is centrally described. This is because it is described under the premise that the high speed printing operation for business use is mainly carried out by using the plain paper. When the present invention is actually executed, it is not necessary to limit the recording paper to the plain paper. It is possible to carry out the wide application to the recording paper to be actually applied, irrespectively of the kind of the paper.

The above-mentioned inks and additives are used to produce the trial ink having the following composition.

[Ink a]

-continued

| | |
|---|---|
| Pigment (CABO-JET300 (Made by Cabot Corporation)) | 5 Weight % |
| Polyethylene glycol 200 | 10 Weight % |
| 1,3-Propanediol | 15 Weight % |
| Triethylene glycol monoethylether | 3 Weight % |
| Detergent (Sur-Phenol 104 (Made by Air Product)) | 0.3 Weight % |
| Ion-Exchanged Water | Remainder |
| [Ink b] | |
| Pigment (CABO-JET300 (Made by Cabot Corporation)) | 7 Weight % |
| Glycerin | 10 Weight % |
| 1,3-Propanediol | 15 Weight % |
| Diethylene glycol monobutylether | 3 Weight % |
| Detergent (Orfin E1010 (Made by NISSHIN KAGAKU) | 0.3 Weight % |
| Ion-Exchanged Water | Remainder |
| [Ink c] | |
| Pigment (GA (Made by MIKUNI Pixel)) | 3.5 Weight % |
| Glycerin | 8 Weight % |
| 1,5-Hexane Diol | 15 Weight % |
| Diethylene glycol monobutylether | 3 Weight % |
| Detergent (Nymean L-207 (Made by NIHON YUSHI) | 1 Weight % |
| Ion-Exchanged Water | Remainder |
| [Ink d] | |
| Pigment (GA (Made by MIKUNI Pixel Corp.)) | 6 Weight % |
| Polyethylene glycol 200 | 10 Weight % |
| 1,3-Propanediol | 15 Weight % |
| Diethylene glycol monoethylether | 3 Weight % |
| Detergent (Dynol 604 (Made by Air Product) | 0.02 Weight % |
| Ion-Exchanged Water | Remainder |
| [Ink e] | |
| Dye (CI. Direct Black 154) | 6 Weight % |
| Diethylene glycol | 5 Weight % |
| Triethylene glycol monobutylether | 10 Weight % |
| Detergent (Orfin E1010 (Made by NISSHIN KAGAKU) | 1 Weight % |
| Ion-Exchanged Water | Remainder |
| [Ink f] | |
| Pigment (GA (Made by MIKUNI Pixel)) | 7 Weight % |
| Glycerin | 10 Weight % |
| 1,5-Hexane Diol | 15 Weight % |
| Triethylene glycol monothylether | 3 Weight % |
| Detergent (Dynol 604 (Made by Air Prduct) | 0.02 Weight % |
| Ion-Exchanged Water | Remainder |
| [Ink g] | |
| Dye (CI. Direct Black 154) | 5 Weight % |
| Glycerin | 10 Weight % |
| Triethylene glycol monobutylether | 10 Weight % |
| Detergent (Nymean L-207 (Made by NIHON YUSHI) | 1 Weight % |
| Ion-Exchanged Water | Remainder |
| [Ink h] | |
| Dye (CI. Direct Blue 199) | 6 Weight % |
| Diethylene glycol | 11 Weight% |
| Triethylene glycol monobutylether | 10 Weight % |
| Detergent (Orfin E1010 (Made by NISSHIN KAGAKU) | 2 Weight % |
| Ion-Exchanged Water | Remainder |
| [Ink i] | |
| Pigment (CABO-JET200 (Made by Cabot Corporation)) | 3.5 Weight % |
| Polyethylene glycol 200 | 5 Weight % |
| 1,3-Propanediol | 10 Weight % |
| Diethylene glycol monobutylether | 5 Weight % |
| Detergent (Orfin E1010 (Made by NISSHIN KAGAKU) | 0.3 Weight % |
| Ion-Exchanged Water | Remainder |

By the way, in those inks, the additive amounts of the detergents are suitably adjusted such that the surface tension is about 31 to 35 (dyn/cm).

We fill the above-mentioned respective trial inks in the above-mentioned simple ink jet printer for the one dot line output, and execute the printing of the one dot line for each trial ink, and then measure the line width and the TEP value. Moreover, we fill the same trial ink in an ink jet printer MJ-520 made by Seiko Epson Corporation, which uses a marketed piezoelectric element having a resolution of 720 dpi (Main Scanning)×360 dpi (Sub Scanning), and print out a character of a patch of full duty and a font size of 10.5 points, and then carry out the subjective evaluations of the character and the patch density.

The subjective evaluations of the character and the patch density are carried out at three stage evaluations of ○, Δ, and X. As for the density, the patch portion is expanded by using an optical microscope. Then, it is judged under the following judgment standard, depending on whether or not the paper fiber is viewed from the portion between the dots.

○: The portion between the dots is painted over, and the density is sufficiently dense.

Δ: Here and there, the paper fibers are viewed from the portion between the dots, and the density is slightly thin.

X: The portion between the dots is not painted over, and the density is also thin.

Also, the subjective evaluation of the character is carried out under the following judgment standard, on the basis of the subjective evaluation with a naked eye.

| Ink | TEP Value | Line Width | Density Evaluation | Character Printing Evaluation |
|---|---|---|---|---|
| (a) | 9.6 | 97 | ○ | ○ |
| (b) | 7.5 | 87 | ○ | ○ |
| (c) | 9.5 | 92 | ○ | ○ |
| (d) | 8.9 | 81 | ○ | ○ |
| (e) | 9.3 | 90 | ○ | ○ |
| (f) | 12.5 | 102 | ○ | Δ |
| (g) | 21.5 | 99 | ○ | x |
| (h) | 8.9 | 65 | x | ○ |
| (i) | 8.9 | 70 | x | ○ |
| (j) | 15.7 | 80 | Δ | Δ |

○: There is no feathering, and the edge is sharp

Δ: The slight permeation is recognized.

x: The permeation is recognized.

A table 1 shows the result.

As can be also understood from the table 1, in the ink jet printer having the resolution of 720 dpi (Main Scanning)× 360 dpi (Sub Scanning), namely, in the ink jet printer in which the diagonal separation distance between the dots is 79 micro meter, it is proved that the patch density and the permeation of the character (feathering) are both excellent with regard to the ink in which a line width "x" is 79 micro meter or more and the TEP value is 10 or less.

In short, if the separation distance between the adjacent dots in the main scanning direction is assumed to be "a" and the separation distance between the adjacent dots in the sub scanning direction is assumed to be "b", the ink that enables the printing operation, in which the line width "x" of the one dot line is $x=(a^2+b^2)^{1/2}$ and the TEP value is 10 or less, can be regarded as the ink having no problem with regard to the image density and the permeation of the character.

As mentioned above, only the inks composed of the combination of the limited colors are described in the embodiment according to the present invention. However, the present invention is not essentially limited to those colors, inks and the like. For example, it can be also applied not only to the black, but also to a single color such as C (Cyan), M (Magenta), Y (Yellow) and the like. In addition, the range of the present invention is not limited to the range noted in this embodiment. Moreover, the ink according to the present invention is not limited to the ink discharging method using the piezoelectric element. It can be applied to even an ink jet printing apparatus based on a discharging method (bubble jet) using a heating operation.

Also, it is possible to select the resolution to be used in the actual printing, from a plurality of resolutions. Moreover, in the ink jet printer for automatically controlling a driving timing or a driving time of the piezoelectric element on the basis of the selected resolution, or a heating timing, a heating time and a heating temperature of a heater for heating the ink and the like, those controls with regard to the discharge of the ink are corrected to then perform the above-mentioned operations for the sake of the ink selection on any one of the resolutions and thereby select the suitable ink. Thus, even if another selectable resolution is applied, it is possible to attain the printing operation having the sufficient image density without any permeation.

For example, in the ink jet printer in which the resolutions of 1200 dpi, 600 dpi, 400 dpi and 300 dpi can be selected, it is not always necessary to individually check the allowance or rejection of the ink with regard to all the resolutions of 1200 dpi, 600 dpi, 400 dpi and 300 dpi. The approximately properly printed result can be reserved, for example, by selecting the proper ink with regard to the resolution of 600 dpi and then controlling the discharging condition of the ink with regard to the other resolutions.

In a case that the resolution to be actually used at a time of the printing operation can be selected from a plurality of resolutions and a special control is not performed on the discharge condition of the ink, it is desired that the value corresponding to the roughest resolution of the selectable resolutions is applied to the values of "a", "b" in $x=(a^2+b^2)^{1/2}$ in order to reserve the density of the solid patch when the low resolution is selected to then carry out the printing operation.

Strictly speaking, the roughest resolution in this explanation is the roughest resolution of the resolutions except the resolution of a draft mode. Usually, the usage object of the draft mode is to carry out a trial printing in order to check an outline of a character or the image. Thus, the reduction in the image density of the solid patch portion is not important. Hence, it is not necessary at all to adjust the ink so as to carry out the perfect paint-out in this draft mode.

The printing system of the ink jet printer according to the present invention considers the resolution of the printer and the property of the recording paper, and quantitatively defines the property of the ink in the range in which the paint-out of the full duty can be attained and the occurrence of the feathering does not bring about a trouble. Thus, it is possible to attain the printing operation having the sufficient image density without any permeation and without any excessive usage of the ink.

Also, it is possible to exactly protect the occurrence of the feathering if the plain paper is used. Thus, it is possible to carry out a lot of printing at a low cost. In particular, it is possible to effectively suppress the occurrence of the feathering and the reduction in the image density in the case of the carbon black print in which a single color is printed only once. Hence, it is possible to sufficiently cope with even the business application in which a large amount of text printing is mainly carried out.

Moreover, the counter-plan required to improve the image density and prevent the feathering is attained only by the improvement of the ink. Thus, it is not necessary to add the special improvement to the ink jet printer and the recording paper. Hence, the printing property can be improved at the low cost.

Furthermore, in the case of the ink jet printer in which the resolution can be selected in the printing operation, the property of the ink is adjusted so as to obtain the sufficient image density even if the lowest resolution except the draft mode is used. Thus, it is possible to surely solve the paint over in the portion between the ink dots, which was especially the traditional problem in the full duty print at the low resolution.

The method of selecting the ink in the ink jet printer according to the present invention is designed so as to judge the allowance or rejection of the ink, only on the basis of the TEP value and the line width when the straight line having no overlap of the dots is drawn by the ink jet printer. Thus, the process required to judge the allowance or rejection of the ink is largely simplified as compared with the conventional ink selecting method of actually printing the character and the solid image and then judging the allowance or rejection of the ink. Hence, the total time and labor cost are reduced which are required to develop and select the ink. Moreover, the reduction in a development cost leads to the reduction in a manufacturing cost of an apparatus.

Also, the straight line to judge the allowance or rejection of the ink is drawn by driving the feeding mechanism that is superior in the straightly feeding accuracy and the resolution, in the orthogonal-two-axis feeding mechanisms of the ink jet printer. Thus, the evaluation of the TEP value done in accordance with the deviation in the distance between the ideal border line and the actually drawn image boundary becomes further accurate. Moreover, the linearity of the straight line is reserved to thereby make the boarder smoother. Hence, it is possible to accurately measure the line width and also possible to further exactly select the ink suitable for the resolution of the printer and the property of the recording paper.

The invention may be embodied in other specific forms without departing from the spirit or essential characteristic thereof. The present embodiments are therefore to be considered in all respects as illustrative and not restrictive, the scope of the invention being indicated by the appended claims rather than by the foregoing description and all changes which come within the meaning and rage of equivalency of the claims are therefore intended to be embraced therein.

The entire disclosure of Japanese Patent Application No. 2001-141316 (Filed on May 11, 2001) including specification, claims, drawings and summary are incorporated herein by reference in its entirety.

What is claimed is:

1. A printing system of an ink jet printer which discharges an ink from said ink jet head and carries out a printing operation while relatively shifting an ink jet head and a recording paper in two shifting directions orthogonal to each other, wherein when a resolution in any one shifting direction of said two shifting directions is assumed to be "a" and a resolution in the other shifting direction orthogonal to said one shifting direction is assumed to be "b" and when said ink jet head is driven to draw a straight line having no overlap of dots in said other shifting direction along said one shifting direction, a property of said ink is adjusted on the basis of said resolution "a", said resolution "b" and a property of said recording paper, in such a way that a line width "x" of this straight line is $x=(a^2+b^2)^{1/2}$ and a TEP value is 10 or less.

2. A printing system of an ink jet printer according to claim 1, wherein a colorant included in said ink is a pigment.

3. A printing system of an ink jet printer according to claim 2, wherein said pigment is a carbon black.

4. A printing system of an ink jet printer according to claim 1, wherein said recording paper is a plain paper.

5. A printing system of an ink jet printer according to claim 1, wherein said ink jet head is driven by a piezoelectric element.

6. A printing system of an ink jet printer according to claim 1, wherein said ink jet head is driven by heating said ink.

7. An ink selecting method of an ink jet printer which discharges an ink from said ink jet head and carries out a printing operation while relatively shifting an ink jet head and a recording paper in two shifting directions orthogonal to each other, wherein a resolution in any one shifting direction of said two shifting directions is assumed to be "a", and a resolution in the other shifting direction orthogonal to said one shifting direction is assumed to be "b", and an operation for driving said ink jet head and then drawing a straight line having no overlap of dots in said other shifting direction along said one shifting direction is repeatedly executed while different kind of ink is applied each time, and a line width x of said straight line is measured for each execution, and an ink satisfying a condition that this line width x is $x=(a^2+b^2)^{1/2}$ and a TEP value of said straight line is 10 or less is selected as an ink suitable for said ink jet head and said recording paper.

8. An ink selecting method of an ink jet printer according to claim 7, wherein said one shifting direction is superior to said other shifting direction in straight shifting accuracy and resolution at a time of a shifting operation.

* * * * *